United States Patent [19]

Gen et al.

[11] Patent Number: 4,756,446

[45] Date of Patent: Jul. 12, 1988

[54] DOUBLE-WALLED CONTAINER

[75] Inventors: Yojiro Gen, Tokyo; Tsuneo Naganuma, Hyogo, both of Japan

[73] Assignee: Glico Dairy Co., Ltd., Tokyo, Japan

[21] Appl. No.: 909,259

[22] Filed: Sep. 19, 1986

[30] Foreign Application Priority Data

Mar. 28, 1986 [JP] Japan ..... 61-44852[U]

[51] Int. Cl.[4] ..... B65D 21/00

[52] U.S. Cl. ..... 220/410; 220/408; 220/445; 220/469

[58] Field of Search ..... 220/410, 408, 409, 427, 220/446, 447, 74, 89 B, 495, 469

[56] References Cited

U.S. PATENT DOCUMENTS

| | | | |
|---|---|---|---|
| Re. 19,362 | 11/1934 | Justheim | 220/469 X |
| 2,213,837 | 9/1940 | Gill | 220/410 |
| 2,507,425 | 5/1950 | Swartout | 220/408 |
| 2,899,098 | 8/1959 | Gits | 220/410 |
| 3,130,288 | 4/1964 | Monaco et al. | 220/408 X |
| 3,275,180 | 9/1966 | Optner et al. | 220/445 |
| 3,365,092 | 1/1968 | Blessing | 220/469 X |
| 4,478,349 | 10/1984 | Haverland, Jr. et al. | 220/410 |
| 6,084,519 | 6/1985 | Yagasaki . | |

*Primary Examiner*—Steven M. Pollard
*Attorney, Agent, or Firm*—Alan H. Levine

[57] ABSTRACT

A double-walled container formed of synthetic resinous material, including generally hemispherically-shaped outer and inner walls nested together with a gap between the walls, a flange extending from the outer periphery of the inner wall to the top edge of the outer wall, the flange and outer wall being permanently joined together so as to form the two walls into a unitary structure. Preferably, the walls are joined together by ultrasonic welding. The top edge of the outer wall is formed with a stepped configuration defining a seat which accommodates a sealing portion of the flange, the sealing portion being fused to the seat. The sealing portion of the flange may either be continuous or formed of individual projections spaced apart along the circumference of the flange. The top surface of the flange may either be flush with, or in a plane above, the uppermost surface of the top edge of the outer wall. A plurality of strengthening ribs project inwardly from the inner surface of the outer wall, the ribs being equidistantly spaced apart along the circumference of the other wall. The flange rests upon the upper surfaces of the ribs.

8 Claims, 2 Drawing Sheets

FIG. 1
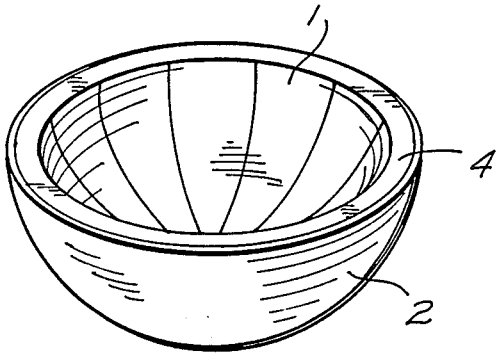
FIG. 2
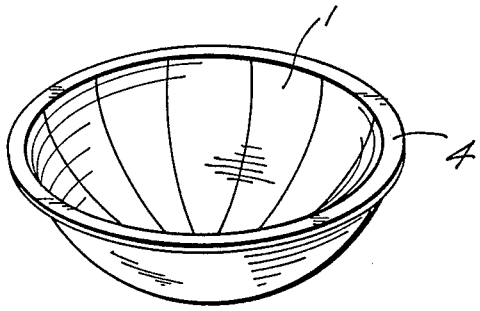
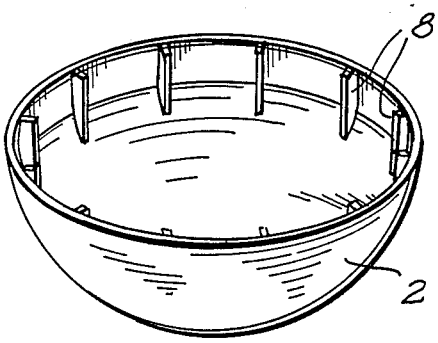
FIG. 3
FIG. 6
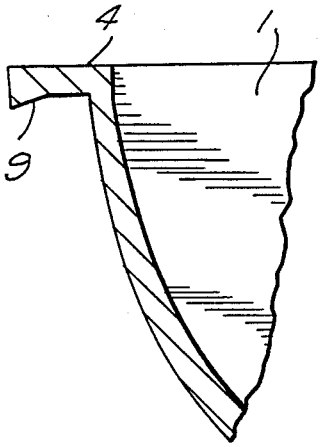
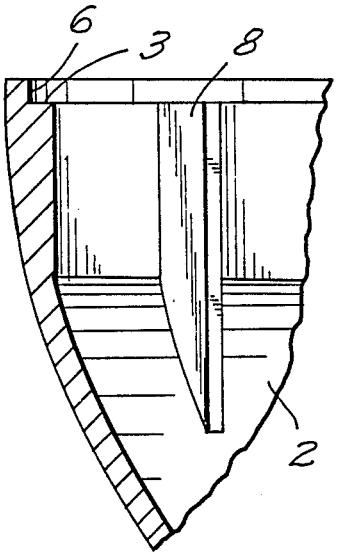
FIG. 7

FIG. 4
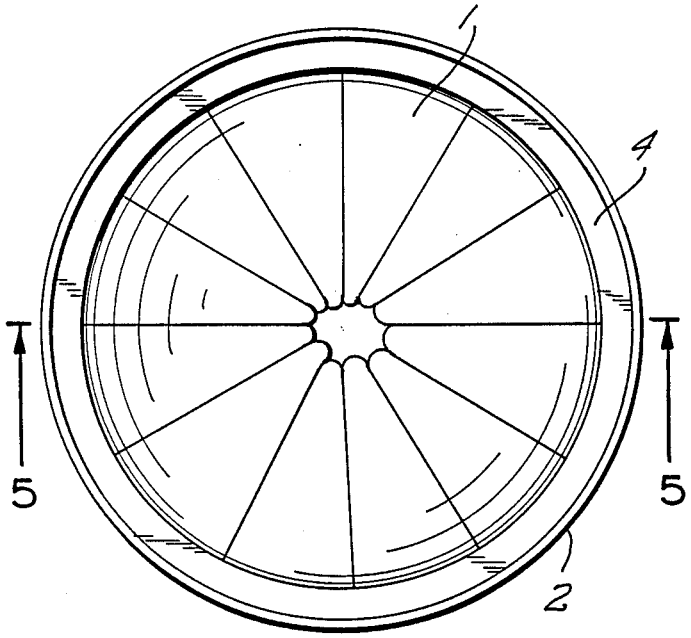
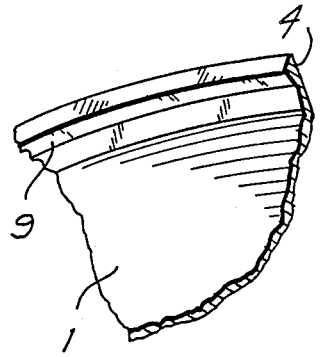
FIG. 8
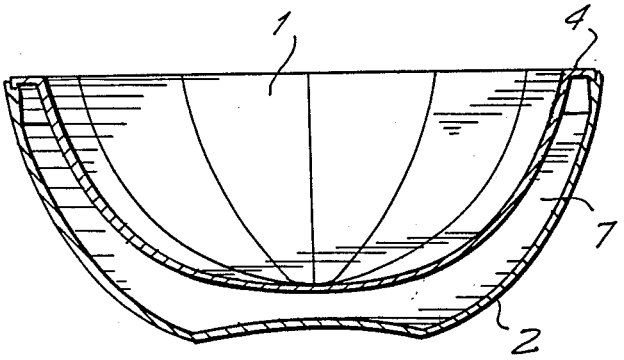
FIG. 5
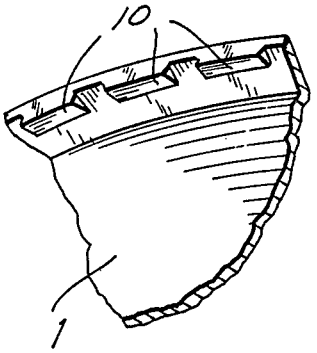
FIG. 9

DOUBLE-WALLED CONTAINER

This invention relates to containers, particularly for food products, effective to keep the contents of the container warm or cool, and which may be formed and decorated so that when the container is handled, one has the sense of touching a real piece of fruit.

Hemispherically-shaped containers have been known heretofore having the general shape of one-half of a piece of citrus fruit, e.g., a grapefruit, which has been cut across its center axis. When such a container is of single-wall construction, it is necessary to form the container with an outwardly projecting flange so as to provide a top surface to which a closure for the container can be applied. Because of the outwardly projecting flange, it is difficult to make such a container look like a real piece of fruit.

Such a container, having a double-wall construction, involving inner and outer hemispherically-shaped walls nested together is illustrated and described in Japanese Published Utility Model Application No. Sho-60-84519. In the container of that Japanese application, the inner and outer walls are brought into engagement, and interfitted, at the upper edges of the walls and the bottoms of the walls. The inner wall is actually force fit, or snapped, into the outer wall to join the two walls together, this action being permitted by the inherent resilience of the synthetic resinous material of which the two walls are fabricated. Problems encountered with this type of container are that when a force is applied to the outside of such a container, relative movement between the inner and outer walls can cause a creaking noise, and the two walls can even pop apart. Moreover, difficulty has been experienced in attempting to reduce the costs of these containers because of inability to effect automation of producing them on a mass production basis.

It is an object of the present invention to overcome these problems by providing a hemispherically-shaped container formed of synthetic resinous material which, although having a double-walled construction, is actually produced as a unitary structure.

It is another object of the invention to provide such a container which has the appearance and feel of an actual piece of fruit.

It is a further object of the invention to provide such a container which can be made economically on a mass production basis.

Additional objects and features of the invention will be apparent from the following description, in which reference is made to the accompanying drawings.

In the drawings:

FIG. 1 is a perspective view of a container according to the present invention;

FIG. 2 is a perspective view of the inner wall of the container prior to its being joined to the outer wall of the container;

FIG. 3 is a perspective view of the outer wall of the container prior to its being joined to the inner wall;

FIG. 4 is a top view of the container of FIG. 1;

FIG. 5 is a cross-sectional view taken along line 5—5 of FIG. 4;

FIG. 6 is a fragmentary cross-sectional view, on an enlarged scale, of a portion of the inner wall of the container prior to its being joined to the outer wall;

FIG. 7 is a fragmentary cross-sectional view, on an enlarged scale, of the outer wall of the container prior to its being joined to the inner wall;

FIG. 8 is a fragmentary perspective view of the inner wall of the container; and FIG. 9 is a fragmentary perspective view of an alternative embodiment of the inner wall of the container.

The container chosen to illustrate the present invention is generally hemispherically-shaped, is open at the top, and is formed of an inner wall 1 and an outer wall 2 (FIGS. 1–5). Each of the walls 1 and 2 is formed of a synthetic resinous material, and preferably has a wall thickness of between about 0.5 and 0.9 millimeter. The resinous material used to form the inner and outer walls, in the thickness described, has a considerable degree of resilience.

The upper portion of outer wall 2 is somewhat thickened, as indicated in FIG. 7, and the top surface **6*a* of the outer wall is formed with a step-shaped indentation. This indentation has a bottom wall 3 and a side wall 6 defining a seat for accommodating the sealing edge portion 9 (FIG. 6) of a flange 4 projecting radially outwardly from the upper periphery of inner wall 1. The relative dimensions of seat 3,6 and flange 4,9 are such that when flange 4 is placed on the seat, the top surface of flange 4 is either flush with the top surface 6*a* of outer wall 2, or projects slightly above surface 6*a***, the latter condition being illustrated in FIG. 5.

After the parts are assembled as just described, and as illustrated in FIG. 5, sealing portion 9 of flange 4 and the region of seat 3,6 of outer wall 2 are heated, such as ultrasonically, to melt the plastic in these regions and permanently fuse flange 4 to seat 3,6. Inner wall 1 and outer wall 2 are thereby formed into a unitary structure.

If the top surface **6*a* of outer wall 2 were to be higher than the top surface of flange 4 of inner wall 1, difficulty would be experienced in sealing a cover to the container so as to close it. It is for this reason that the top surfaces 4 and 6*a* are preferably made flush with each other, although the top surface of flange 4 projecting above the top surface 6*a*** is acceptable.

It will be appreciated that the radial dimensions of flange 4 of inner wall 1 and indentation 3,6 of outer wall 2 define the width of gap 7 (FIG. 5) created between the inner and outer walls. A greater or lesser gap can be achieved by varying the dimensions of flange 4 and indentation 3,6.

A plurality of ribs 8 (FIGS. 3 and 7) project inwardly from the inner surface of outer wall 2, the upper edge of each rib being at the level of bottom wall 3 of the indentation in the top surface **6*a* of outer wall 2. Preferably, ribs 8 are equidistantly spaced around the circumference of outer wall 2. Ribs 8 serve to strengthen outer wall 2, and they also serve to support flange 4, which rests upon the upper surfaces of the ribs. The ribs, therefore, prevent inner wall 1 from moving downwardly within outer wall 2**, and also serve to center the inner wall within the outer wall. Any suitable number of ribs may be employed; however, preferably more than ten are used.

As mentioned above, to form inner wall 1 and outer wall 2 into a unitary structure, sealing portion 9 of flange 4 is fused to seat 3,6 of outer wall 2. Sealing portion 9 is, as shown in FIG. 8, a continuous annular part of flange 4. Alternatively, as illustrated in FIG. 9, the sealing portion of flange 4 can be individual projections 10 spaced apart along the circumference of the flange. Where sealing portion 9 is employed, a continuous melt connection is provided between flange 4 and seat 3,6. Where sealing portion 10 is used, there will be intermittent melt connections between flange 4 and seat 3,6. Fusion of flange 4 to seat 3,6 is preferably formed ultrasonically. However, high frequency heating, or any other type of suitable heating means, may be employed to produce the permanent fusion between inner wall 1 and outer wall 2.

Preferably, one or more small apertures, e.g., of about 0.1 mm in diameter, may be formed in the bottom of outer wall 2 so that air within gap 7 is free to flow outwardly when the container is squeezed. This helps to give the container the resilient feel of a natural piece of fruit.

In use, the container of the present invention is filled with contents to be packaged. Such contents may be fruit salad or fruit jelly corresponding to the fruit-like appearance of the container. A cover or lid, formed of a suitable sheet material, is then placed on the top surface of flange 4 (and also on the top surface *6a*, if those top surfaces are flush) and sealed to that surface so as to close the container.

The container of the present invention looks like real fruit, such as a grapefruit or an orange, and is resilient enough to feel like such fruit. As pointed out above, the inner and outer walls of the present container are formed into a unitary structure by fusion, and are not simply snap fit together. Consequently, the present container is not only of high strength, but can be made economically by an automated mass production system.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A double-walled container having the appearance of one half of a piece of natural fruit which is generally spherical in shape, the container comprising:

a generally hemispherically-shaped outer wall formed of a synthetic resinous material, the top edge of the outer wall being formed with a radially-inwardly-facing stepped configuration defining an annular seat, the stepped configuration being located soley in the top edge and inner surface of the outer wall and the outer wall having no outwardly projecting flange, a generally hemispherically-shaped inner wall, within the outer wall, formed of a synthetic resinous material, the external diameter of the inner wall being smaller than the internal diameter of the outer wall so as to provide a gap between the two walls, a plurality of strengthening ribs projecting inwardly from the inner surface of the outer wall into the gap between the two walls, a flange extending radially outwardly from the top of the inner wall, the periphery of the flange engaging the annular seat of the outer wall, and the flange resting upon the upper surfaces of the ribs, and the periphery of the flange and the annular seat of the outer wall being fused together, so as to form the two walls into a unitary structure.

2. A double-walled container as defined in claim 1 wherein the top surface of the flange is flush with the uppermost surface of the top edge of the outer wall.

3. A double-walled container as defined in claim 1 wherein the top surface of the flange is located in a plane above the uppermost surface of the top edge of the outer wall.

4. A double-walled container as defined in claim 1 wherein the strengthening ribs are equidistantly spaced apart along the circumference of the outer wall.

5. A double-walled container as defined in claim 1 wherein the peripheral edge of the flange is formed as a sealing portion accommodated in the annular seat formed in the top edge of the outer wall, the sealing portion being thicker than the remainder of the flange.

6. A double-walled container as defined in claim 5 wherein the sealing portion is a continuous annular part of the flange.

7. A double-walled container as defined in claim 5 wherein the sealing portion comprises individual projections spaced apart along the circumference of the flange.

8. A double-walled container as defined in claim 1 wherein said ribs are so configured as to center the inner wall within the outer wall.

* * * * *